US005280679A

United States Patent [19]

Edelman

[11] Patent Number: 5,280,679

[45] Date of Patent: Jan. 25, 1994

[54] APPARATUS AND METHOD FOR DRYING NAIL POLISH

[76] Inventor: Estelle F. Edelman, 3300 NE. 191st St. Apt. 1502, Miami Beach, Fla. 33180

[21] Appl. No.: 993,106

[22] Filed: Dec. 18, 1992

[51] Int. Cl.[5] ..... F26B 19/00

[52] U.S. Cl. ..... 34/66; 34/202

[58] Field of Search ..... 34/202, 20, 13, 66

[56] References Cited

U.S. PATENT DOCUMENTS 2,184,858 11/1938 Goodman .
2,262,274 7/1939 Fingerlin .
2,389,822 6/1944 Simmons .
2,734,282 2/1956 Nemeth .
3,287,824 11/1966 Selditz .
3,864,847 2/1975 Friedman et al. .
4,193,209 3/1980 Lovison et al. .
4,255,871 3/1981 Sigman .
4,464,906 8/1984 Outlaw ..... 34/202
5,084,984 2/1992 Duchoud et al. .

*Primary Examiner*—Henry A. Bennett
*Attorney, Agent, or Firm*—Richard C. Litman

[57] ABSTRACT

An improved fingernail or toenail dryer that uses air cooled almost to freezing directed at nails that have been recently polished. The palm of the hand or sole of the foot thus being treated rests on a plate heated to a temperature sufficient to maintain comfort during the drying process. For hygienic improvement of the manicure or pedicure environment, the device also includes an integral roll of sanitary paper to allow for the easy dispensing of a portion of the paper over the heated plate and the cold air drying zone.

13 Claims, 1 Drawing Sheet

APPARATUS AND METHOD FOR DRYING NAIL POLISH

BACKGROUND OF THE INVENTION

1. Field of the Invention

The present invention relates to cosmetic adornment. More specifically, it relates to manicures and pedicures. Even more specifically, it relates to an apparatus and method for drying fingernails or toenails with optimum efficiency when gauged against time and additionally provides improved assurance of sanitation for the customer.

2. Description of the Prior Art

In beauty shops all over the country, one of the major sources of income is manicures and pedicures, i.e. the cleaning, toning, and polishing of the finger and/or toe nails. One of the problems inherent in the process is that persons with limited time, for example on their lunch hour, on the way home after work, on their way to pick up children from school or daycare, or merely out trying to get the shopping done, must wait on the premises of the shop until the polish dries or else (in the case of fingernails) risk ruining the finish that has been so painstakingly applied. In the case of the pedicure, unless living in a warm climate and wearing sandals or some other type of open-toed footwear, there is no choice at all—customers have to wait until the drying process has been completed before they can put on their stockings and shoes.

Another concern is that of fungi that can be trapped and spread around the periphery of the nails. In many states, there are laws requiring the beautician to provide, not necessarily a sterile, but a clean support surface for the customer's hand or foot while the polish is being applied. This custom is honored more in the breach than the observance, with busy shops only giving a cursory swipe at best, using a paper towel or the like.

Nail drying apparatus are well known in the art. In this discussion they are broken down into three groups.

The first group, listed below are nail polish dryers that utilize heat. As the present invention uses cooled air to dry the nail polish, these patents are not discussed in detail.

| PATENT NO. | INVENTOR |
|---|---|
| 2,184,858 | Goodman |
| 2,262,274 | Fingerlin |
| 2,734,282 | Nemeth |
| 3,287,824 | Selditz |
| 3,864,847 | Friedman et al. |
| 4,255,871 | Sigman |

The next three patents neither heat nor cool the air directed at the nails to be dried.

In U.S. Pat. No. 2,389,822 issued on Nov. 27, 1945 to Paul G. Simmons, there is shown a nail polish dryer where separate finger receiving passages are provided for each finger and the thumb. Air is directed past the tips of the fingers and is vented from the device by outlets.

The next patent of interest in this group is U.S. Pat. No. 4,193,209 issued on Mar. 18, 1980 to Lovison et al. This discloses a fingernail dryer where the device is equipped with a handrest to aid in both the application of the polish and that is positioned such that air driven by a fan and deflected by the vanes 28 speeds the drying of the polish.

Lastly in this category is U.S. Pat. No. 5,084,984 issued on Feb. 4, 1992 to Christian Duchoud et al. In this patent there is shown a clamshell type of housing where, when the device is opened by tilting the cover back on its hinge axis, contact strips are brought together, providing power to a fan that drives air through the drying zone.

The last patent to be considered is U.S. Pat. No. 4,464,906 issued on Aug. 14, 1984 to Joyce Outlaw. In this patent, the air is cooled below ambient temperature before it is directed onto the fingernails. In the specification, the temperature discussed is between 45 and 65 degrees Fahrenheit.

None of the above inventions and patents, taken either singly or in combination, is seen to describe the instant invention as claimed.

SUMMARY OF THE INVENTION

The present invention is an improved fingernail or toenail dryer that uses air cooled almost to freezing directed at nails that have been recently polished. The palm of the hand or sole of the foot thus being treated rests on a plate heated to a temperature sufficient to maintain comfort during the drying process. For hygienic improvement of the manicure or pedicure environment, the device also includes an integral roll of sanitary paper to allow for the easy dispensing of a portion of the paper over the heated plate and the cold air drying zone.

Accordingly, it is a principal object of the invention to provide for quick drying of nail polish by directing air cooled to almost the freezing point into the area proximate the polished nails.

It is another object of the invention to provide a heated plate adapted to receive the palm of a hand or sole of a foot, the plate being heated to a sufficient temperature whereby comfort is maintained during the period of time it takes to dry the nails.

It is a further object of the invention to have, integral with the device, a roll of sanitary paper to allow for covering the commonly used areas with a sheet to provide a more hygienic environment during the drying process.

Still another object of the invention is to provide a method of applying and drying nail polish wherein the time it takes one coat of the polish to dry and the time it takes to apply one coat of polish is approximately the same, thus making for more efficient use of the facility where the procedure is taking place.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
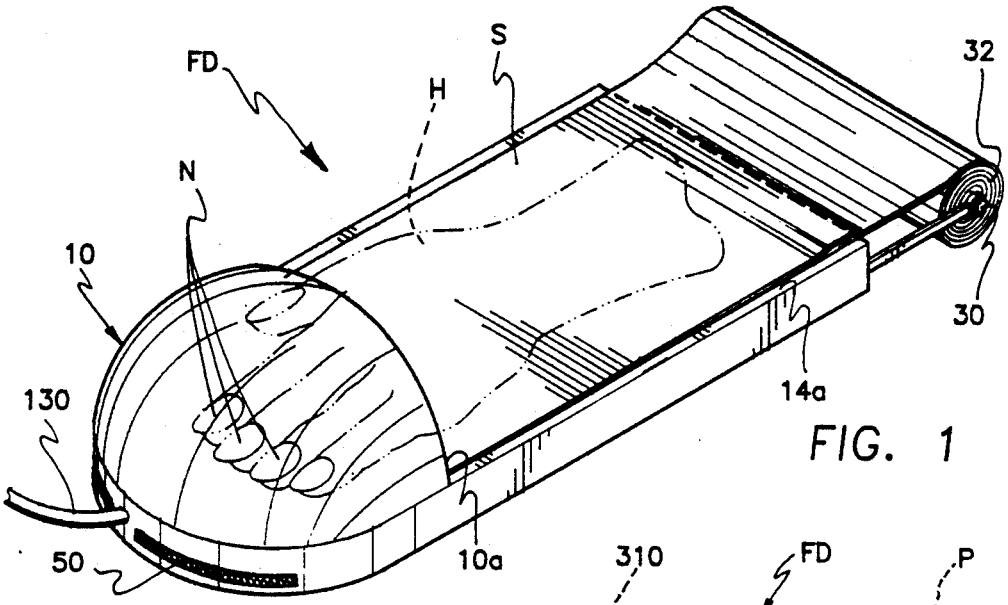
FIG. 1 is an environmental perspective view of the nail polish dryer showing a hand placed on the heating plate and the fingernails located in the drying zone.

The fingernail or toenail dryer FD has an enclosure 10 that partially surrounds the drying zone 12 and has an enclosure opening 10*a* in it that is large enough to accommodate the toes or fingertips of an average hand or foot. There is also shown, in FIG. 3, the power switch P that turns the device on and off. The power switch P is located proximate a power supply 70 that is connected in the standard manner to a cord 72 and a plug 74. The power supply is connected to the fan motor 22*m* by circuit 80. Likewise, the power supply is connected to the electric heating element 310. In the preferred embodiment, there is no need for further external control adjustment means because the unit, as described hereinafter, operates through automatic thermostats or the like. Additional external controls could be added, though, if desired. In FIG. 1 there is shown a hand H (in broken lines) resting on the support plate 14 and placed in such a way that the nails N are within the drying zone 12. The arrows F show the direction of the cooled air drawn through the refrigerant coils 20 by the fan 22. Regarding the temperature of the air, the following graph shows the results of test results run with a freon-type refrigerant coil and a temperature monitoring gauge. A layer of polish was applied to the nails and then they were placed in a stream of air cooled to the referenced temperature for approximately 90 seconds.

| TEMP (F.) | CONDITION OF NAIL POLISH |
|---|---|
| 50° | tacky |
| 45° | tacky |
| 40° | less tacky |
| 38° | barely tacky |
| 34° | substantially dry |
| 32° | substantially dry |

"Tacky", as the term is used here should be understood to mean a partially dried state where the polish is still subject to marring by inadvertent contact. Thus it is seen that as the air approaches freezing, the polish will quickly become substantially dry, i.e. not subject to marring by contact of the covered nail with another object. The advantage of this is twofold. In a professional beautician's shop, as in any business, time is money. The more customers one can serve within a set time period, the more income one produces. The second advantage is that in many cases, more than one layer of polish is applied to the nails. The above-referenced time period allowed for the drying test (90 seconds) corresponds to the time it takes an experienced operator to apply the polish to the nails of one hand or foot. Thus, multiple layers can be applied alternating one appendage with the other and the manicure or pedicure is quickly accomplished without the nuisance, for the customer at any rate, of having to wait idly either between layers of polish or at the end of the procedure.

Figure 2:
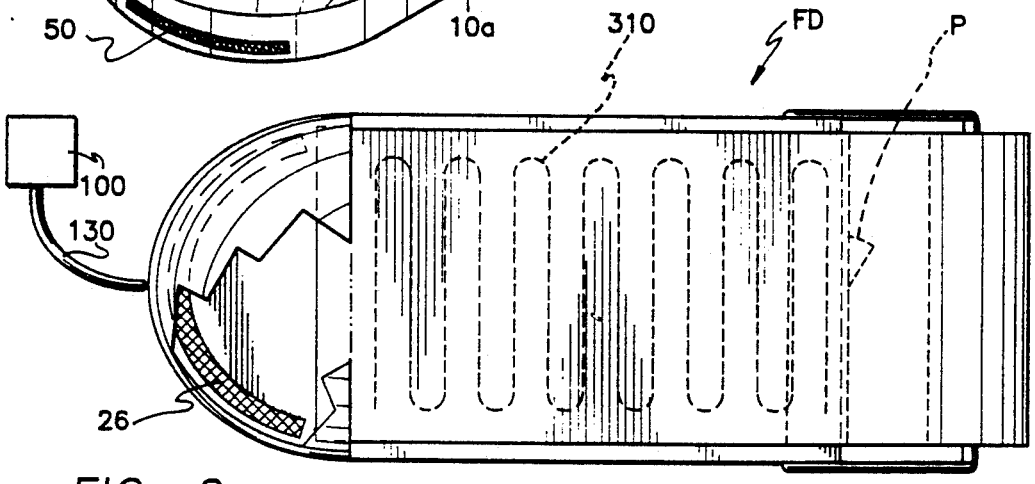
FIG. 2 is a top view of the nail polish dryer with the enclosure partially cut away to reveal the air vents that transmit the cold air into the drying zone.
Figure 3:
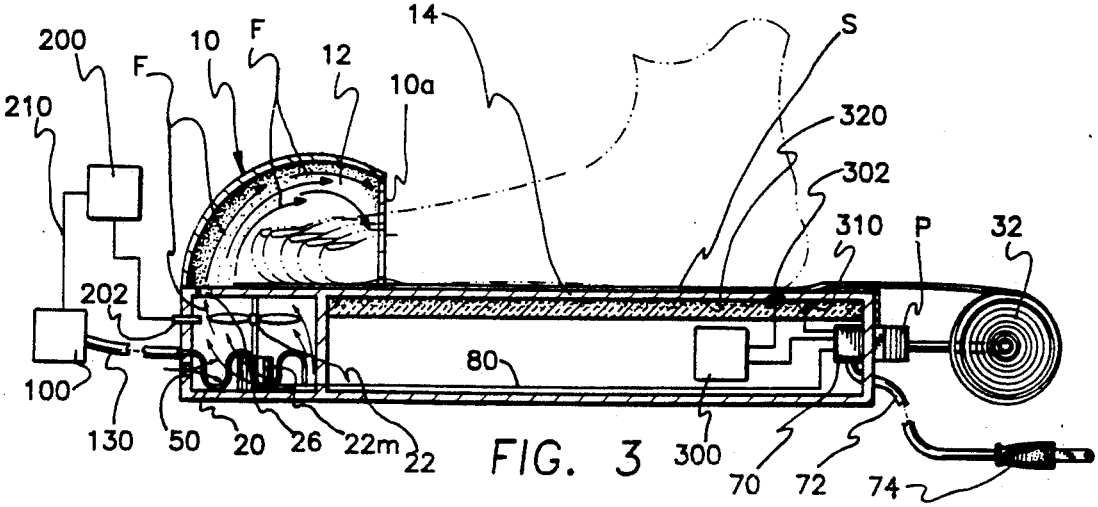
FIG. 3 is a side cutaway view of the nail polish dryer showing a foot placed in the device for drying of the polished toenails and revealing internal details.

The discussion now turns to more details pertaining to the structure of the invention. For the cooling of the airflow as mentioned above there are refrigerant coils 20 and a fan 22 having a fan motor 22*m*. The fan 22 moves the air past the coils 20 and into the drying zone 12. The refrigerant coils 20 are connected by an insulated sleeve 130, as shown in FIGS. 2 and 3, to a conventional condenser and compressor combination 100 well known in the refrigeration or related arts. In the drawings only one fan is shown, but it should be understood that this is only one of a myriad of arrangements that could be used to direct the chilled air flow into the drying zone 12. For example, two fans could be used, one to input the air towards the coils 20 through the air intake 50 and then another to direct the air towards the drying zone 12. Other arrangements are possible, of course, and would be obvious to one of ordinary skill in the art.

The cooling means represented by the refrigerant coils 20 and the condenser/compressor 100 are likewise only one possible arrangement to bring about the chilling of the air. Another cooling method, using a thermoelectric refrigeration unit employing a Peltier element is disclosed in the Outlaw patent, cited above in the description of the prior art and hereby incorporated by reference. Other methods would occur to one of ordinary skill in the refrigeration or related arts. A temperature control means 200 is included, being a standard thermostat in communication with a probe 202 located proximate the coils 20 and the fan blades 22 and having a feedback circuit 210 connected to the refrigeration means to keep the temperature approximately 32 to 34 degrees Fahrenheit. This cold air is vented into the drying area 12 through air vents 26, shown in FIG. 2. The air then passes out of the enclosure 10 through the enclosure opening 10*a*.

Even though the time of exposure to this chilled air is relatively short, lasting only 90 seconds or so, to prevent any discomfort to the person whose hand or foot is placed on the support plate 14, the support plate 14 has a controlled heating means associated with it to keep the support plate 14 at a comfortably warm temperature. This type of controlled heating means is well known in the art, and could be made up of a control thermostat 300, shown in FIG. 3 attached to an electrical heating element 310, shown in FIG. 2, that is embedded in a layer 320 made of a rosin or like substance. The thermostat would monitor the temperature of the support plate 14 by means of a support plate sensor 302, shown in FIG. 3. The controlled heating means could alternatively include a hot water pipe, or any other type of heat generating and conducting means that could be envisaged.

Mounted on the support plate 14 proximate the end opposite the enclosure 10 is a roller mount 30 that holds a roll of sanitized paper 32. In this usage "sanitized" does not imply that the paper is sterile, but merely free from obvious dirt. This sheet of paper can be unrolled to substantially cover the top 14*a* of the support plate 14 thus providing a replaceable sanitary covering means therefore. In FIGS. 1 and 3 this covering sheet is designated S. In use, the beautician or operator would pull the end of the sheet out to cover the top 14*a* of the support plate 14 and the floor 12*a* of the drying zone 12. The sheet S would be held in place on the top 14*a* of the support plate 14 by the client's hand or foot during the drying operation or, if desired, suitable clamps (not shown) could be provided. The sheet S provides for a more hygienic environment during the drying process.

Optionally, it would be possible to further augment the speed of the drying process by utilizing a chemical drying aid. One such chemical is SET IT QUICK, manufactured by Essie Cosmetics, Ltd. of Lynbrook, NY, which contains heptane, tri-chloroethane, mineral oil, a fragrance, and methyl salicylate. Many other liquids, applied by either brush, dipping, or spray could be used. Some of these others are also commercially marketed as nail drying aids, but a number of simple volatile liquids could be used. Isopropyl alcohol, for example, at a standard strength of 71% is a possibility. Good results can also be obtained with the same chemical at a strength of roughly 91%. These substances would be applied to the fresh coat of polish before the hand or foot was placed on support plate 14 and the nails introduced into drying zone 12.

It is to be understood that the present invention is not limited to the sole embodiment described above, but encompasses any and all embodiments within the scope of the following claims.

I claim:

1. An apparatus for the drying of nail polish comprising:

a drying zone including enclosure means to enclose said drying zone, said enclosure means including a means defining an opening;

an air cooling means for cooling a flow of air;

an air directing means for directing said flow of cool air within said enclosed drying zone;

a hand or foot support plate; and a heating means for said hand or foot support plate; whereby a hand or foot having nail polish freshly applied to the nails thereof is placed on said support plate with the nails of the hand or foot inserted by said means defining an opening into said enclosure means, and thus into said drying zone, and said air directing means directs said flow of cool air into said drying zone while said heating means for said support plate maintains said support plate at a comfortable temperature, thus said flow of cool air within said drying zone speeds the drying of the applied layer of nail polish on the nails while said heating means for said support plate provides a comfortable environment.

2. An apparatus as claimed in claim 1 wherein said air cooling means includes a condenser, a compressor, and an evaporator.

3. An apparatus as claimed in claim 1 wherein said air cooling means includes a thermoelectric refrigeration unit comprising a Peltier element.

4. An apparatus as claimed in claim 1 wherein said air directing means includes at least one fan configured to draw air past said air cooling means and further includes a plurality of openings configured within the floor of said enclosure means.

5. An apparatus as claimed in claim 1 further comprising a replaceable sanitary covering means for said hand or foot support plate.

6. An apparatus as claimed in claim 5 wherein said replaceable sanitary covering means further comprises a roll of sanitary paper mounted integrally with said support plate, said roll of sanitary paper being configured to be unrolled over the top surface of said support plate and the floor of said enclosure.

7. An apparatus as claimed in claim 1 wherein said air cooling means further includes a thermostat control to provide cool air at a predetermined temperature.

8. An apparatus as claimed in claim 7 wherein said predetermined temperature is below 45° Fahrenheit.

9. An apparatus as claimed in claim 8 wherein said predetermined temperature is within the range of 32° to 34° Fahrenheit.

10. A method of drying nail polish after the polish is applied to nails comprising the steps of:

1) providing an enclosure having an opening adapted to receive fingernails or toenails, said enclosure thus providing a drying zone;

2) providing a means to cool air and to direct said cooled air through said drying zone;

3) providing a means to regulate said cooled air below 45° Fahrenheit; whereby fingernails or toenails are inserted into said opening of said enclosure, thus being placed into said drying zone and said cooled air, said air being cooled below 45° Fahrenheit is directed through said drying zone thus drying the applied polish at a substantially faster rate than would be accomplished otherwise.

11. The method according to claim 10 further including the step of applying a liquid polish drying agent to the polished nail before inserting the nail into said drying zone.

12. The method according to claim 11 where the liquid is a solution of isopropyl alcohol in water, the strength of said solution being greater than 70%.

13. A method of drying nail polish after the polish is applied to nails comprising the steps of:

1) providing an enclosure having an opening adapted to receive fingernails or toenails, said enclosure thus providing a drying zone;

2) providing a means to cool air and to direct said cooled air through said drying zone;

3) providing a means to regulate said cooled air within the range of 32°–34° Fahrenheit; whereby fingernails or toenails are inserted into said opening of said enclosure, thus being placed into said drying zone and said cooled air, said air being cooled to between 32°–34° Fahrenheit is directed through said drying zone thus drying the applied polish at a substantially faster rate than would be accomplished otherwise.

* * * * *